US011627760B2

(12) United States Patent
Zhang

(10) Patent No.: US 11,627,760 B2
(45) Date of Patent: Apr. 18, 2023

(54) HEAT REGULATING DEVICE FOR HOOKAH

(71) Applicant: Mei Zhang, Guangdong (CN)

(72) Inventor: Mei Zhang, Guangdong (CN)

( * ) Notice: Subject to any disclaimer, the term of this patent is extended or adjusted under 35 U.S.C. 154(b) by 338 days.

(21) Appl. No.: 16/872,042

(22) Filed: May 11, 2020

(65) Prior Publication Data

US 2021/0267274 A1 Sep. 2, 2021

(30) Foreign Application Priority Data

Feb. 28, 2020 (CN) ..... 202020232046.7

(51) Int. Cl.
*A24F 1/30* (2006.01)
*A24F 5/10* (2006.01)

(52) U.S. Cl.
CPC . *A24F 5/10* (2013.01); *A24F 1/30* (2013.01)

(58) Field of Classification Search
None
See application file for complete search history.

(56) References Cited

U.S. PATENT DOCUMENTS

2019/0364960 A1* 12/2019 Nguyen ..... A24F 1/30

FOREIGN PATENT DOCUMENTS

| | | | |
|---|---|---|---|
| CN | 104039181 | A | 9/2014 |
| CN | 104244748 | A | 12/2014 |
| CN | 205922908 | U | 2/2017 |

* cited by examiner

*Primary Examiner* — Kelly M Gambetta
*Assistant Examiner* — Katherine A Will

(57) ABSTRACT

The present invention discloses a heat regulating device for a hookah, including a lid and a base. The lid and the base are movably connected to form a cavity for placing tobacco or other combustible substances. The upper part of the base has an annular groove; and the lid has a fastener which is hook-shaped; the fastener extends downward and inward and is embedded in the annular groove. The fastener and the annular groove are configured to improve the connection stability of the lid and the base. In the event of an accident, such as unexpected tipping over, the lid won't easily fall off from the base, so tobacco or other combustible substances can be contained in the device to reduce the possibility of scald, even fire and other accidents, thus improving the safety performance of the heat regulating device.

10 Claims, 5 Drawing Sheets

HEAT REGULATING DEVICE FOR HOOKAH

CROSS-REFERENCE TO RELATED APPLICATIONS

This application claims the benefit of priority from Chinese Patent Application No. 202020232046.7, filed on Feb. 28, 2020. The content of the aforementioned application, including any intervening amendments thereto, is incorporated herein by reference in its entirety.

TECHNICAL FIELD

This application relates to apparatuses for smoking, and more specifically to a hookah.

BACKGROUND

In daily life, a growing number of people start to pay attention to the way of smoking, in order to reduce the harm of harmful substances in tobacco to health. The hookah has become a new and fashionable smoking way, and has been gradually accepted and promoted in Europe, USA, the Middle East regions, and some coastal cities in China. The hookah is also called Arabic hookah, which originated in India, was gradually accepted in Arab, and then became a part of Arabic culture and tradition. It is inhaled with a water pipe after being filtered with water or other liquid. The hookah flavor is usually made of fresh tobacco, dried fruits, honey and other materials.

The existing hookah accessories, such as hookah pot, which is usually placed on hookah bowl, generates smoke by heating the hookah flavor in the hookah bowl from top to bottom, for example, the head of the hookah disclosed in Chinese Patent Application No. 201280072621.X.

As the technology advances, the hookah gradually evolved into an electric heating device controlled by a chip, such as the atomizing chip and atomizer for electronic hookahs and electronic hookah using the same disclosed in Chinese Patent Application No. 201620885574.6. The electronic hookah usually includes a lid with an internal lid and a lower lid. The air inlet is on the top, and the air is introduced from the top to bottom. The air inflow is adjusted through the rotation of the internal lid and the external lid for thermal adjustment. However, such hookah has a complex structure, it is hard to manufacture. In addition, the air is conducted from top to bottom, which easily results in the incomplete combustion of the fuel (such as charcoal) in contact with the metal at the bottom. The bottom of the existing devices includes multiple parts that are connected by locking screws, which is inconvenient to produce. Further, if the device is accidentally tipped over during use, the lid may fall off and then the charcoal may roll off from the device, which can easily result in scald and other incidents, or even fire. Therefore, such device is not safe to use.

Chinese Patent Application No. 201380004090.5 disclosed a heating management accessory for hookah, including a plate base, an isolation wall, an internal lid and an external lid. The plate base is configured to be placed on a hookah bowl on the top of hookah, transmit the heat from charcoal or other heat sources to the tobacco which is located beneath it; an isolation wall is connected to the base plate, an internal lid matches with it; and an external lid is attached to the internal lid loosely. This heat management device allows rotation, ventilation and thermal adjustment. The structure of this invention can help tobacco or other combustible substances burn rather thoroughly, but it only changes the air supply for the tobacco or other combustible substances through the settings of the air passageway. Due to the need of placing the tobacco or other combustible substances, the internal lid and the isolation wall are connected by a simple covering without any fixing structures, which results in the unstable structural relationship there between. In the event of tipping over or being touched unexpectedly, the internal lid may easily fall off from the isolation wall, which may cause the heated tobacco or combustible substances roll off from the heating management accessory, leading to scald or other accidents, or even fire. Thus it's not safe to use.

SUMMARY

To solve the above-mentioned problems, the present invention provides a heat regulating device for a hookah, in which the stability of the connection between the external lid and the base is improved through the structural configuration, so that the internal and external structures of this device are stably connected, and the external lid and the base are effectively locked during use to prevent the tobacco and combustible substances from falling out, thereby improving the safety performance of the device.

Further, the present invention aims to provide a heat regulating device for a hookah, in which the air inflow of the heat regulating device is adjusted by adjusting the shielding parts to meet the needs of different users. Meanwhile, the configuration of the heat regulating device is compatible with hookah bowls of various sizes, thereby facilitating the convenience in use.

To achieve the above purposes, the present invention adopts the following technical solutions.

A heat regulating device for a hookah, including a lid and a base which are movably connected to form a cavity; an annular groove is provided at an upper part of the base; the lid has a fastener which is hook-shaped; and the fastener extends downward and inward and is embedded in the annular groove.

In this invention, the heat regulating device comprises the lid and a base, and a cavity is formed by the lid and the base for placing tobacco or other combustible substances; the annular groove is provided at the upper part of the base, and the lid has a fastener which is hook-shaped; and the fastener extends downward and inward, and is embedded in the annular groove. The fastener and the annular groove are arranged to improve the connection stability of the lid and the base, so that the lid and the base are stably connected. In the event of an accident (such as unexpected tipping over), the lid won't easily fall off from the base, and thus tobacco or other combustible substances can be contained within the heat regulating device to reduce the possibility of scald, even fire or other accidents and improve the safety performance of the heat regulating device during use.

Further, an upper side wall of the annular groove has a notch for accommodating the fastener, which is larger than the fastener so that the fastener extends into a bottom of the annular groove and slide along the annular groove, and is embedded into the annular groove.

Further, a side wall of the base has a first air inlet, and the lid extends downward with a shielding part at a corresponding position of the first air inlet; the shielding part can move with the rotation of the lid to block the first air inlet to change the air inflow. When the lid moves, the first air inlet is shielded by the shielding part to different extent so that the air volume from the air inlets is adjusted. When the first air inlets are fully shielded, the air inflow is the minimum. On the opposite, when the first air inlet is not shielded, the air inflow is the maximum. Therefore, the shielding part can be adjusted according to the required combustion speed and temperature.

Further, the lid has at least one air outlet unit, and each air outlet unit includes at least one air outlet; the air outlet is on the lid and forms a sign part for arranging a sign. The air outlet may be in an irregular arc shape to help the air flow into the interior of the device and then flow out via the air outlet, thus enhancing the air circulation.

Further, the base includes an outer wall and an inner wall; the inner wall of the base is annular; the inner wall and the outer wall of the base are integrally formed, and an annular gap is formed therebetween; the shielding part moves along this annular gap; the first air inlet is arranged on a side wall of the outer wall of the base; the curved shielding part extending downward from the lid is inserted into the annular gap and matches with the annular gap.

The shielding part extends downward from the lid. At least two shielding parts are provided and are evenly located at an edge of the lid. Each shielding part is curved, so that it can slide in the annular gap.

Further, a first handle fixing part extends horizontally from an edge of the lid; the fastener is integrally connected with the first handle fixing part, and is located at a lower part of the first handle fixing part; a lid handle is fixedly mounted at the first handle fixing part and outside the fastener. The lid handle is usually made from heat insulating materials. The lid can be rotated by operating the lid handle to adjust the shielding part, thus achieving the convenient adjustment.

The inner wall of the base is provided with a second air inlet communicated with the first air inlet. The second air inlet may be T-shaped and corresponds to the first air inlet.

Further, a first supporting part extends upward from a center of a bottom of the outer wall of the base; at least two second supporting parts which are evenly arranged in a ring shape extend from the base; and the at least two second supporting parts are located outside the first heat conducting holes. The first supporting part and the second supporting parts are configured to support the tobacco or combustible substances (such as charcoal) placed inside the heat regulating device, so as to reduce the contact between the tobacco or combustible substances and the base and increase the contact area between the air and the tobacco or combustible substances, thereby realizing more sufficient combustion.

Further, an outside wall of the outer wall of the base further has a second handle fixing part; the second handle fixing part is fixedly mounted with a base handle. The base handle helps with stabilization during use and the removal of the device after use. The base handle is generally made from heat insulating materials.

Further, a bottom of the base is provided with at least two circular steps which are in a stepped shape. The circular steps of different sizes can be placed on different hookah bowls to match with hookah bowls of different sizes.

The heat regulating device of the present invention provides a safety mechanism through the structural improvement, to ensure the safety and reliability of the heat regulating device. The lid and the base are stably connected, so the lid won't easily fall off from the base, which reduces the possibility of scald, even fire or other accidents, thereby improving the safety performance of the heat regulating device.

In addition, the way that air is introduced from the side increases the air inflow, helps the air flow more easily into the interior of the device, so that the tobacco or combustible substances burn more thoroughly. The air inflow is adjusted by adjusting the shielding parts to meet the actual needs of different users. Meanwhile, the heat regulating device is compatible with hookah bowls of various sizes and thus is convenient to use.

DETAILED DESCRIPTION OF EMBODIMENTS

To make the purpose, technical solutions, and advantages of the present invention more clear, the present invention will be illustrated with reference to the accompanying drawings and embodiments. It should be understood that the specific embodiments described herein are only illustrative, and are not intended to limit the scope of the present invention.

Figure 1:
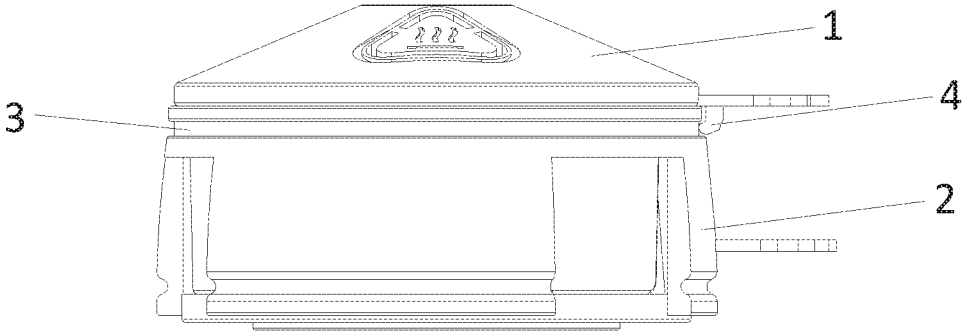
FIG. 1 is a front view of a heat regulating device for a hookah.
Figure 2:
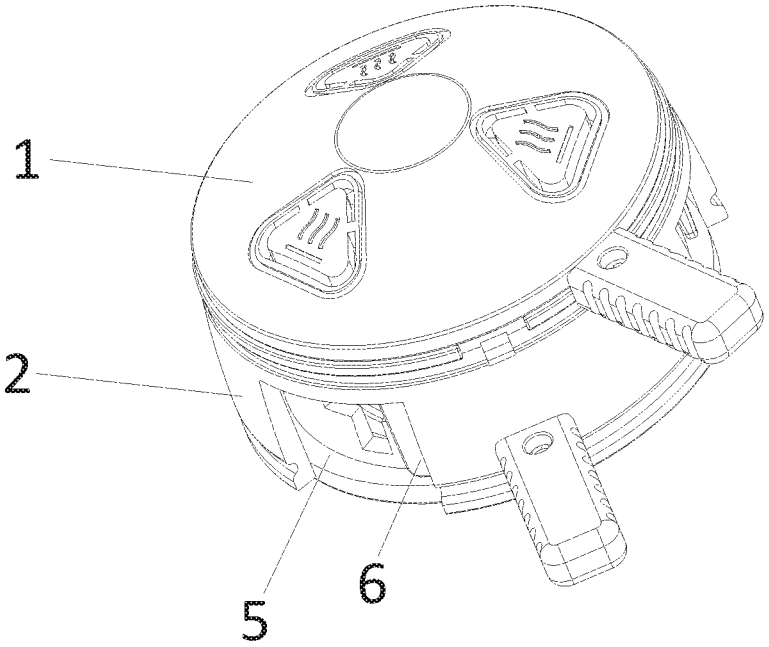
FIG. 2 is a perspective diagram of the heat regulating device for the hookah.
Figure 3:
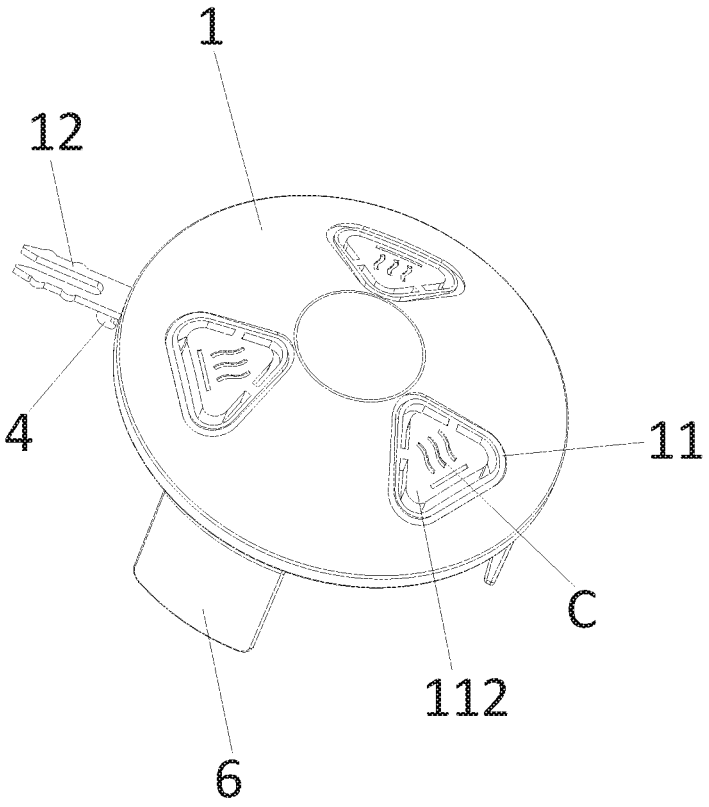
FIG. 3 is a perspective view, from the top, of a lid of the heat regulating device for the hookah.
Figure 4:
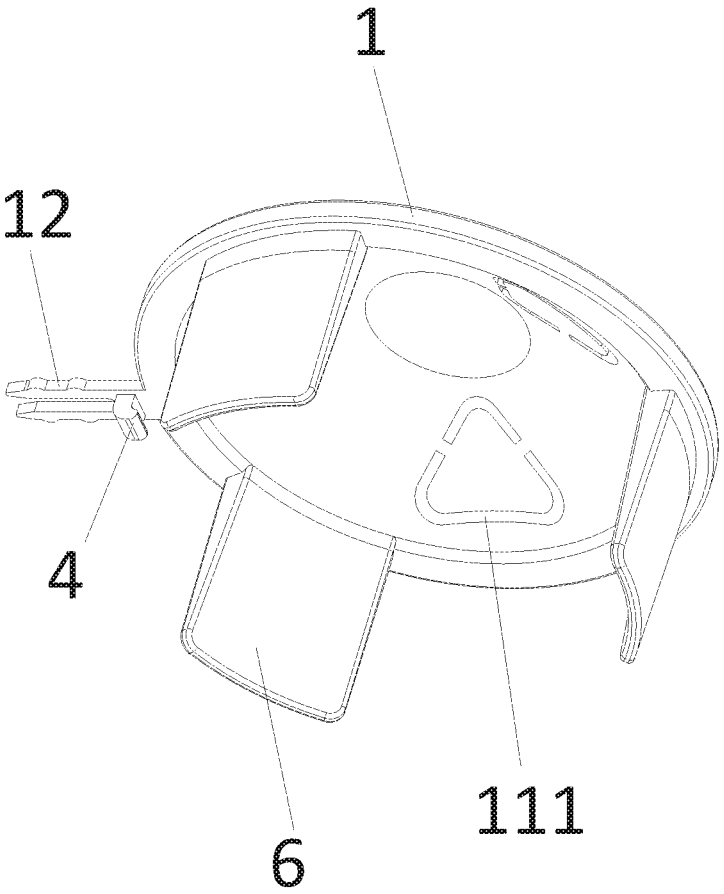
FIG. 4 is a perspective view, from the bottom, of the lid of the heat regulating device for the hookah.
Figure 5:
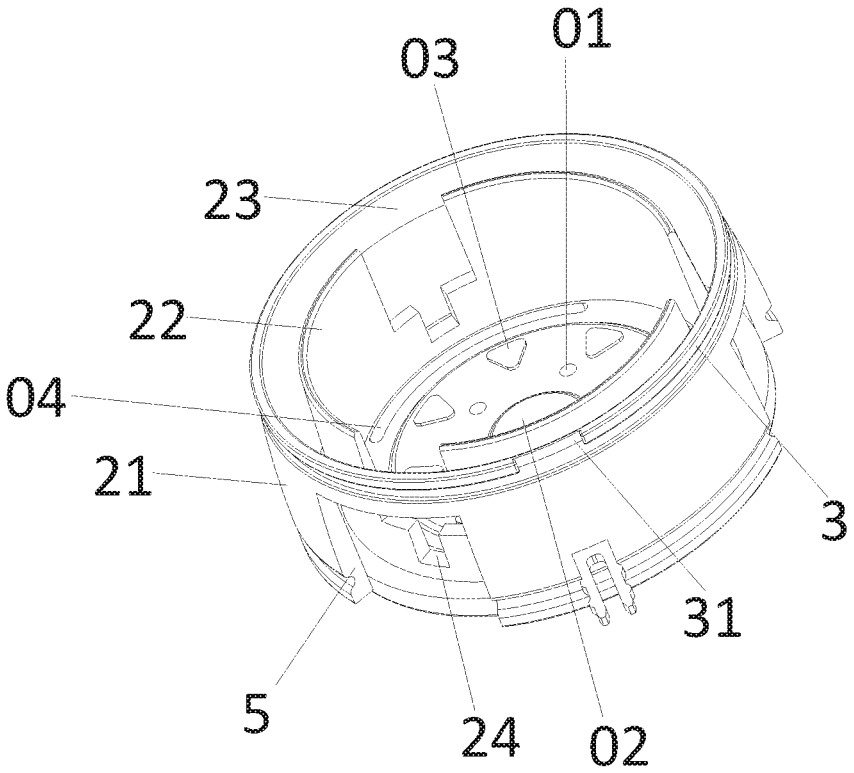
FIG. 5 is a perspective view, from the top, of a base of the heat regulating device for the hookah.
Figure 6:
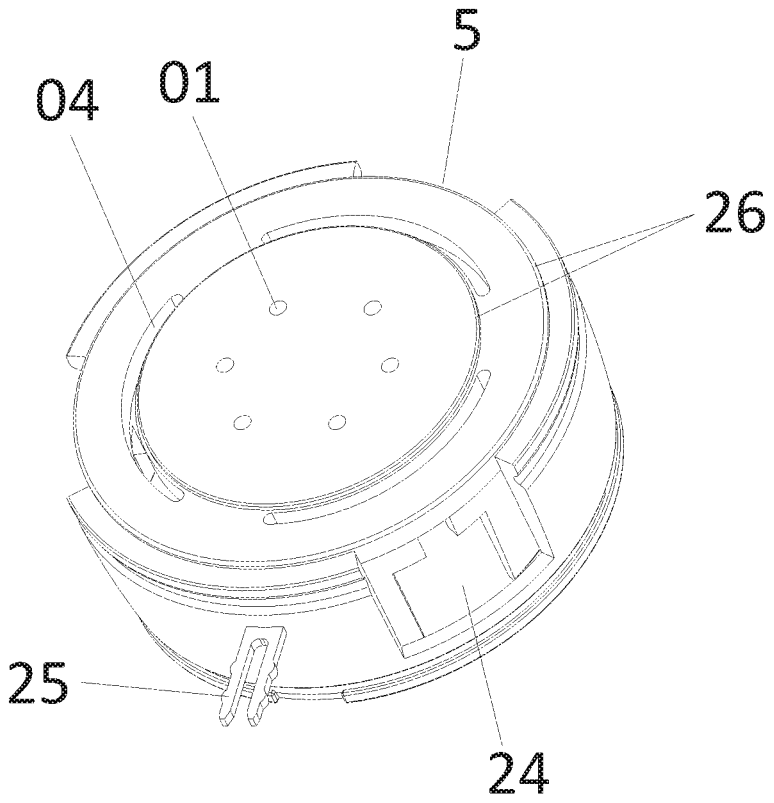
FIG. 6 is a perspective view, from the bottom, of the base of the heat regulating device for the hookah.
Figure 7:
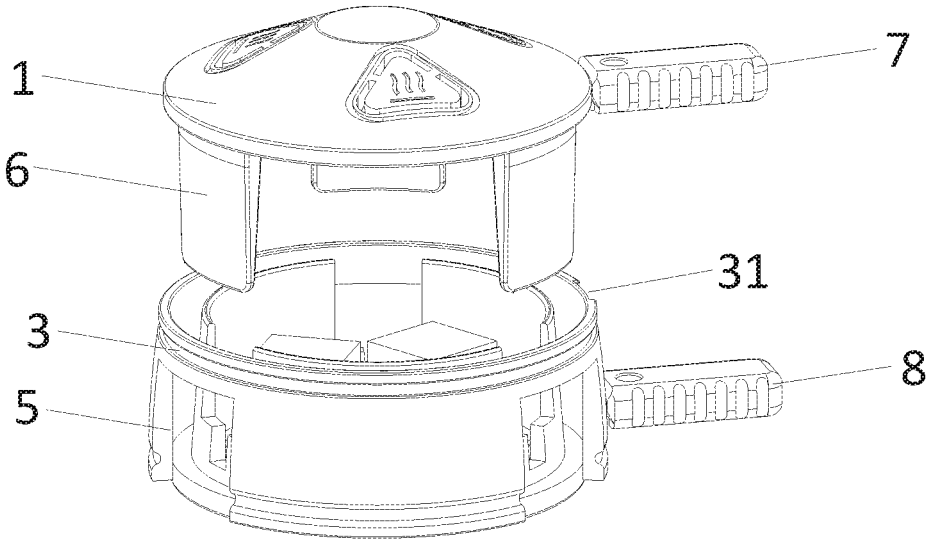
FIG. 7 is an exploded view of the heat regulating device for the hookah.

As shown in FIGS. 1-7, this embodiment provides a heat regulating device for a hookah, including a lid 1 and a base 2 arranged on a hookah bowl; the lid 1 and the base 2 are movably connected to form a cavity for placing tobacco or combustible substances (such as charcoal); an annular groove 3 is provided at an upper part of the base 2, and the lid 1 is provided with a fastener 4 which is hook-shaped; the fastener 4 extends downward and inward, and is embedded in the annular groove 3.

In this invention, the heat regulating device includes the lid 1 and the base 2 which are moveably connected. The structure of the heat regulating device is simple, and is convenient for production and assembly. The annular groove 3 is provided at the upper part of the base 2, and the lid 1 is provided with the fastener 4 which is hook-shaped; the fastener 4 extends downward and inward, and is embedded in the annular groove 3. The fastener 4 and the annular groove 3 are arranged to improve the connection stability of the lid 1 and base 2, so that the lid 1 and base 2 are stably connected. In the event of an accident (such as accidentally tipping over), the lid 1 won't easily fall off from the base 2, and thus the tobacco or combustible substances can be contained within the heat regulating device, which reduces the possibility of scald, even fire and other incidents, and improves the safety performance during use.

In this embodiment, an upper side wall of the annular groove 3 is provided with a notch 31 for receiving the fastener 4; the fastener 4 extends into the annular groove 3 from the notch 31, and slides along the annular groove 3. The notch 31 is provided at a part of the annular groove 3 and is larger than the fastener 4, so that the fastener 4 extends into the bottom of the annular groove 3 and slides along the annular groove 3 and is embedded into the annular groove 3.

In this embodiment, a first air inlet 5 is provided on a side wall of the base 2, and the lid 1 extends downward with a shielding part 6 at a corresponding position of the first air inlet 5; the shielding part 6 can move with the rotation of the lid to block the first air inlet 5 to adjust the air inflow. As the lid 1 rotates, the shielding part 6 shields the first air inlet 5 to different degrees, so that the air inflow from the first air inlet 5 is adjusted. When the first air inlet 5 is fully shielded, the air inflow is minimum; when the first air inlet 5 is not shielded by the shielding part, the air inflow is maximum. Therefore, the shielding part 6 can be adjusted according to the required combustion speed and temperature.

In this embodiment, the lid 1 is further provided with at least one air outlet unit 11, and each air outlet unit 11 includes at least one air outlet 111 arranged on the lid 1, and the at least one air outlet 111 forms a sign part 112 for setting sign C. The air outlet 111 may be in an irregular arc shape and helps the air flow into the interior of the heat regulating device from the first air inlet 5 and then flow out via the air outlet 111, thus enhancing the air circulation.

In this embodiment, the base 2 includes an outer wall 21 and an inner wall 22. The inner wall 22 of the base is annular; the inner wall 22 and the outer wall 21 of the base are integrally formed, and an annular gap 23 is formed therebetween; the shielding part 6 moves along the annular gap 23; the first air inlet 5 is arranged on a side wall of the outer wall 21 of the base; the curved shielding part 6 extending downward from the lid 1 is inserted into and matches with the annular gap 23.

The shielding part 6 extends downward from the lid 1. At least two shielding parts 6 are evenly located at the edge of the lid 1. Each shielding part 6 is curved, so that it can slide in the annular gap 23.

In this embodiment, a first handle fixing part 12 extends horizontally from an edge of the lid 1. The fastener 4 is integrally connected to the first handle fixing part 12, and is located at a lower part of the first handle fixing part 12. The lid handle 7 is fixedly mounted at the first handle fixing part 12 and outside the fastener 4. The lid handle 7 is usually made from heat insulating materials. The lid 1 can be rotated by operating the lid handle 7 to adjust the shielding parts 6, thus achieving the convenient adjustment.

The inner wall 22 of the base is provided with a second air inlet 24 communicated with the first air inlet 5; the second air inlet 24 may be T-shaped, and usually overlaps with the first air inlet 5.

In this embodiment, the outer wall 21 of the base is provided with at least two first heat conducting holes 01 which are evenly arranged in a ring shape, so that the heat is transmitted to the hookah bowl for baking the hookah paste in the hookah bowl.

In this embodiment, a first supporting part 02 extends upward from a center of a bottom of the outer wall 21 of the base; at least two second supporting parts 03 extend from the outer wall 21 of the base and are evenly arranged in a ring shape and located outside the first heat conducting holes 01. The first supporting part 02 and the second supporting parts 03 are configured to support the tobacco or combustible substances (such as charcoal) placed inside the device, so as to reduce the contact between the tobacco or combustible substances and the base 2 and increase the contact area between the air and the tobacco or combustible substances, thereby realizing more sufficient combustion.

A second heat conducting hole 04 is provided on the base and located between the second supporting part 03 and the inner wall 22 of the base, so that the heat can be transmitted to the hookah bowl for baking the hookah past in the bowl.

In this embodiment, the outer wall 21 of the base is further provided with a second handle fixing part 25 at an outer side wall thereof; the second handle fixing part 25 is fixedly mounted with a base handle 8. The base handle 8 helps with stabilization during use and the removal of the device after use. The base handle 8 is generally made from heat insulating materials.

In this embodiment, a bottom of the base 2 is provided with at least two circular steps 26 which are in a stepped shape. The circular steps 26 of different sizes can be placed on different hookah bowls to match with hookah bowls of different sizes.

The present invention has the following advantages.

Compared to the existing techniques, the heat regulating device of the present invention provides a safety mechanism through structural improvement, to ensure the safety and reliability of the device. The lid and the base are stably connected, so the lid won't easily fall off from the base, which reduces the possibility of scald, even fire and other accidents, thereby improving the safety performance of the heat regulating device during use.

In addition, the way that air is introduced from the side increases the air inflow, helps the air flow more easily into the interior of the device, so that the tobacco or combustible substances burn more thoroughly. The air inflow is adjusted by adjusting the shielding parts to meet the actual needs of different users. Meanwhile, the heat regulating device is compatible with hookah bowls of various sizes and thus is convenient to use.

The above-mentioned embodiment is a preferred embodiment of the present invention, and is not intended to limit the scope of the present invention. Any modification, equivalent replacement and improvement based on the spirit and the principles of the present invention shall fall within the scope of this present invention.

What is claimed is:

1. A heat regulating device for a hookah, comprising a lid and a base;

wherein the lid and the base are movably connected to form a cavity; an upper part of the base has an annular groove; the lid has a fastener which is hook-shaped; and the fastener extends downward and inward and is embedded in the annular groove;

an upper side wall of the annular groove has a notch for accommodating the fastener; the fastener extends into the annular groove from the notch and slides along the annular groove;

a side wall of the base has a first air inlet; the lid has a shielding part which rotates with the lid to shield the first air inlet to adjust air inflow; the lid further has at least one air outlet unit, and the air outlet unit has at least one air outlet which is arranged on the lid and forms a sign part for arranging a sign.

2. The heat regulating device of claim 1, wherein the base comprises an outer wall and an inner wall which is contained in the outer wall of the base; the inner wall of the base is annular; the inner and outer walls of the base are integrally formed, and an annular gap is formed therebetween; the shielding part moves along the annular gap, and the first air inlet is arranged on a side of the outer wall; at least two shielding parts that are curved are evenly provided on the lid and extend downward from an edge of the lid.

3. The heat regulating device of claim 2, wherein the inner wall of the base has a second air inlet which is communicated with the first air inlet.

4. The heat regulating device of claim 2, wherein the outer wall of the base has at least two first heat conducting holes which are evenly arranged in a ring shape.

5. The heat regulating device of claim 4, wherein a first supporting part extends upward from a center of a bottom of the outer wall of the base, and at least two second supporting parts extend from the bottom of the outer wall of the base; the at least two second supporting parts are evenly arranged in a ring shape, and located outside the at least two first heat conducting holes.

6. The heat regulating device of claim 5, wherein the base has a second heat conducting hole which is located between the at least two second supporting parts and the inner wall of the base.

7. The heat regulating device of claim 2, wherein an outside wall of the outer wall of the base further has a second handle fixing part on which a base handle is fixedly mounted.

8. The heat regulating device of claim 1, wherein a bottom of the base has at least two circular steps which are in a stepped shape.

9. A heat regulating device for a hookah, comprising a lid and a base;

wherein the lid and the base are movably connected to form a cavity; an upper part of the base has an annular groove; the lid has a fastener which is hook-shaped; and the fastener extends downward and inward and is embedded in the annular groove; and a first handle fixing part horizontally extends from an edge of the lid; the fastener and the first handle fixing part are integrally formed, and the fastener is located at a lower part of the first handle fixing part; and a lid handle is fixedly mounted on the first handle fixing part, and is located outside of the fastener.

10. The heat regulating device of claim 9, wherein a bottom of the base has at least two circular steps which are in a stepped shape.

* * * * *